US009181717B1

(12) United States Patent
Jamison

(10) Patent No.: US 9,181,717 B1
(45) Date of Patent: Nov. 10, 2015

(54) TRANSPORTABLE FLOORING KIT AND METHOD FOR ASSEMBLING THE SAME

(75) Inventor: Samuel H. Jamison, Philadelphia, PA (US)

(73) Assignee: STAGESTEP, INC., Philadelphia, PA (US)

( * ) Notice: Subject to any disclaimer, the term of this patent is extended or adjusted under 35 U.S.C. 154(b) by 812 days.

(21) Appl. No.: 12/924,874

(22) Filed: Oct. 7, 2010

(51) Int. Cl.
*E04F 15/02* (2006.01)

(52) U.S. Cl.
CPC ..... *E04F 15/02144* (2013.01); *Y10S 52/04* (2013.01)

(58) Field of Classification Search
CPC .. E04F 2201/06; E04F 15/02144; Y10S 52/04
USPC ..... 52/586.1, 586.2, 582.1, 582.2, 591.5, 52/591.4, 177, 403.1, DIG. 4
See application file for complete search history.

(56) References Cited

U.S. PATENT DOCUMENTS 938,430 A * 10/1909 McQuern ..... 52/591.5
2,914,815 A * 12/1959 Alexander ..... 52/592.1
3,341,996 A * 9/1967 Jones et al. ..... 52/309.13
3,456,374 A * 7/1969 Baermann ..... 40/701
3,694,983 A * 10/1972 Couquet ..... 52/384
4,026,086 A * 5/1977 Langley ..... 52/592.6
5,634,309 A * 6/1997 Polen ..... 52/392
7,155,871 B1 * 1/2007 Stone et al. ..... 52/591.4
7,322,159 B2 * 1/2008 Stone et al. ..... 52/741.3
8,234,834 B2 * 8/2012 Martensson et al. ..... 52/747.1
8,291,665 B2 * 10/2012 Sondermann ..... 52/466
8,307,600 B2 * 11/2012 Heartsfield ..... 52/582.1
8,394,217 B2 * 3/2013 Pien ..... 156/71
2001/0017017 A1 * 8/2001 Pacione ..... 52/506.05
2004/0211130 A1 * 10/2004 Horstman et al. ..... 52/177
2005/0183370 A1 * 8/2005 Cripps ..... 52/591.5
2008/0202053 A1 * 8/2008 Guy et al. ..... 52/391
2010/0281810 A1 * 11/2010 Ruland ..... 52/588.1
2010/0319282 A1 * 12/2010 Ruland ..... 52/309.3
2011/0265946 A1 * 11/2011 Pien ..... 156/268

* cited by examiner

*Primary Examiner* — Robert Canfield
(74) *Attorney, Agent, or Firm* — Stuart E. Beck

(57) ABSTRACT

A kit for making a floor on the permanent floor of a venue from modules. Adjacent modules are releasably interconnected by magnetic coupling means.

A flooring module base layer having an upper surface with upwardly facing grooves that include magnetic coupling means for connecting it to a complementary magnetic coupling means on an adjacent activity layer.

A flooring module activity layer having a lower surface with downwardly facing grooves that include magnetic coupling means for connecting it to a complementary magnetic coupling means on an adjacent base layer.

A method for making a floor from a plurality of modules that are placed in contact with each other so that a portion of each module overlies an upwardly facing or downwardly facing portion of each adjacent module. The adjacent modules are coupled to each other by the magnetic coupling means to create a floor of desired area.

23 Claims, 3 Drawing Sheets

TRANSPORTABLE FLOORING KIT AND METHOD FOR ASSEMBLING THE SAME

FIELD OF THE INVENTION

This invention relates to a flooring kit for sport, dance, or exercising activity which comprises a plurality of modules that are provided as a kit which can be assembled without tools for creating a sport, dance, or exercising activity floor.

BACKGROUND OF THE INVENTION

It is desirable to have a flooring kit which can be moved between locations and then easily assembled without tools.

Such a flooring system is advantageous for touring performing and dance companies as well as athletic and sports exhibitors whose activities often require flooring requirements which can not be met by the venues where they appear.

Thus it is desirable for these groups to travel with flooring that meets their exacting requirements, and which can be assembled and then disassembled after use and transported to a new venue after they are used.

Similarly, many venues are available for a variety of performances and exhibitions; each of which have their own flooring requirements. It would be especially advantageous for such venues to have on site kits comprising several different flooring systems that could be easily assembled and disassembled and stored without tools so that the venue could provide flooring suitable for touring performing and dance companies as well as athletic and sports exhibitors in one space.

SUMMARY OF THE INVENTION

With the foregoing in mind, the invention relates generally to a flooring kit for creating a sport, dance, or exercising activity floor without using tools from modules. As many modules as necessary to create a floor of desired are may be used.

The modules will lie side by side on the permanent floor of the venue.

Each module includes base and activity layers. The base layers are for being placed on the permanent floor and the activity layers overlie them.

The base layers and activity layers of adjacent modules are releasably connected to each other by magnetic coupling means.

Another aspect of the invention relates to a base layer for flooring module of the type that comprises a base layer and an activity layer. The upper surface of the base layer includes upwardly facing grooves that include magnetic coupling means which are for connecting the base layer to a complementary magnetic coupling means on an adjacent activity layer.

A further aspect of the invention relates to an activity layer for flooring module of the type that comprises an activity layer and a base layer. The lower surface of the activity layer includes downwardly facing grooves that include magnetic coupling means disposed in each of said downwardly facing grooves for being connected to a complementary magnetic coupling means on an adjacent base layer.

In still another aspect of the invention there is provided a method for making a floor for sport, dance, or exercising activity from a kit without using tools. The method comprising the steps of providing a plurality of modules. Each of the modules includes a base layer and an activity layer. The base and activity layers of each module overlap each other so that a portion of each layer extends past two adjacent edges of the other layer. The modules are moved into contact with each other so that a portion of each activity layer and each base layer overlies an upwardly facing or downwardly facing portion of each base layer and each activity layer of the adjacent module. The adjacent modules are coupled to each other by the magnetic coupling means to create a floor of desired area.

DETAILED DESCRIPTION OF THE PREFERRED

Embodiments of the Invention

Figure 1A:
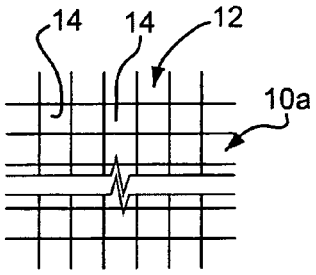
FIG. 1*a* is a plan view of one embodiment of a floor in accordance with the invention.
Figure 1B:
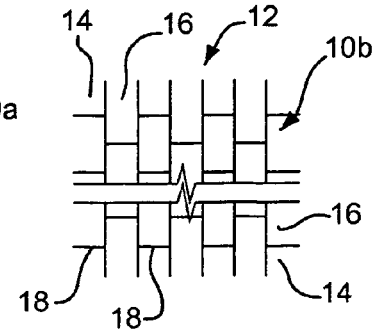
FIG. 1*b* is a plan view of another embodiment of a floor in accordance with the invention.
Figure 1C:
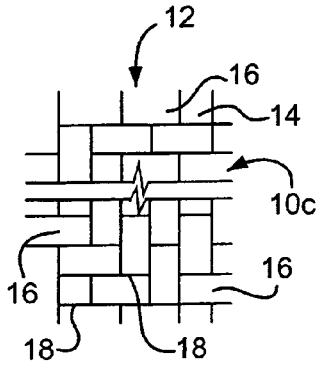
FIG. 1*c* is a plan view of still another embodiment of a floor in accordance with the invention.

Now referring to the drawing for a detailed description of one presently preferred embodiment of the invention there are seen in FIGS. 1*a*, 1*b*, and 1*c* floors 10*a*, 10*b*, and 10*c* which are suitable for sport, dance, exercising or the like and which are constructed from the kits of the invention. The floors 10*a*, 10*b*, and 10*c* are supported on the permanent flooring (not illustrated) of the building, arena or other site where the flooring is to be used.

Floor 10*a* is constructed from a plurality of modules 12. It is constructed in the same manner as floors 10*b* and 10*c*. Accordingly, the structure and method of assembling floor 10*a* will be described in detail; it being understood that floors 10*b* and 10*c* which are also comprised of a plurality of modules 12 are constructed and assembled in the same manner.

Floor 10*a* is assembled from a kit that includes only square modules 14. Floor 10*b* is assembled from a kit that includes both square modules 14 and rectangular modules 16. Floor 10*c* may also be assembled from both square modules 14 and rectangular modules 16, or it can be constructed from only rectangular modules 16.

Floor 10*a* which is constructed from square modules 14 is suitable for most activities. It is especially desirable because the square modules 14 are relatively lightweight and easier to handle than the rectangular modules 16.

However, some activities, such as professional basketball, require that the seams 18 between adjacent modules 12 be broken and not continuous in at least one direction. This is accomplished with the kit of the invention by the use of rectangular modules 16 which are offset by square modules 14, such as seen in FIGS. 1*b* and 1*c* by floors 10*b* and 10*c*.

In furtherance of this last stated goal, the square modules 14 and the rectangular modules 16 are the same width. Further, by making the rectangular modules 16 twice as long as they are wide, flooring with a "brick" pattern as seen in FIG. 1*b* or a "sawtooth" pattern as seen in FIG. 1*c* can be created. The brick and sawtooth patterns may create a pleasing design while at the same time providing flooring for many activities where square modules would not be acceptable.

Figure 2A:
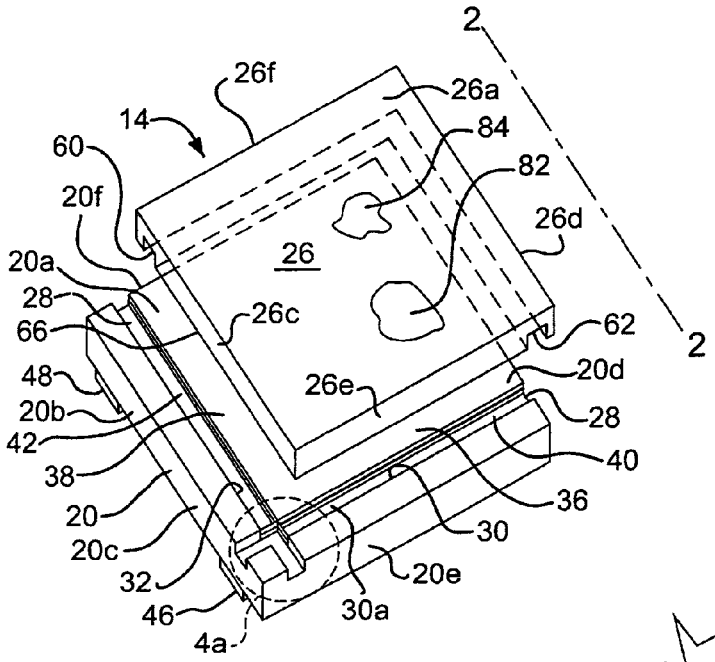
FIG. 2*a* is a top perspective view of the one embodiment of a module constructed in accordance with the invention with the activity layer visible.
Figure 2B:
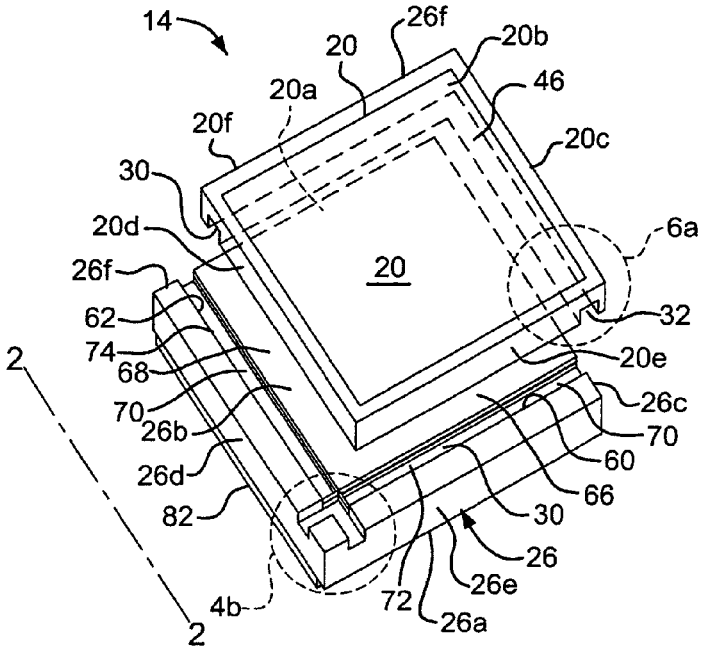
FIG. 2*b* is a top perspective view of the embodiment of the module shown in FIG. 2*a* which has been rotated around axis 2-2 in FIG. 2*a* so that the base layer visible.
Figure 3:
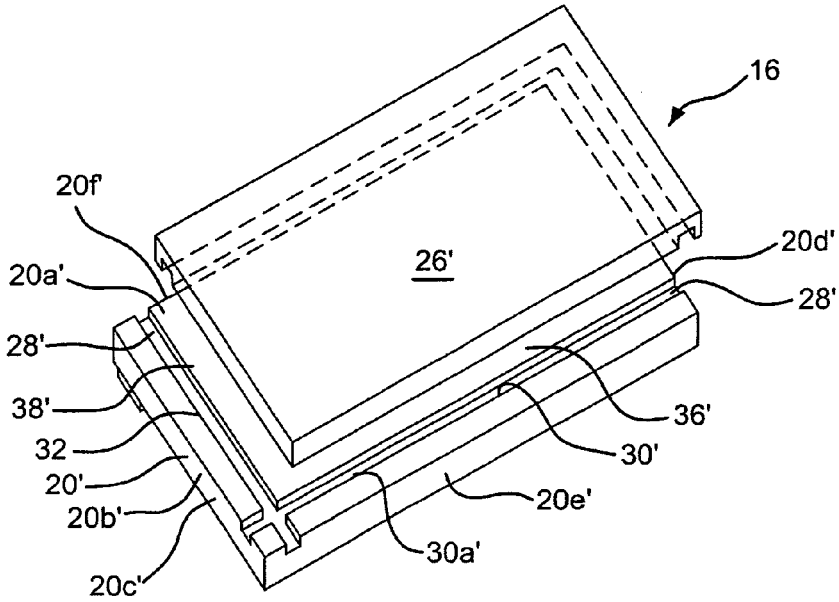
FIG. 3 is a top perspective view of a second embodiment of the invention.

In FIGS. 2*a* and 2*b* the bottom and top of a square module 14 is shown; it being understood that the rectangular modules 16 (FIG. 3) are constructed identically to the square modules, except for the fact that they are twice as long as the square modules 14.

To aid in simplifying the description of the preferred embodiments, a separate description of rectangular module 16 will not be provided; it being understood that except for the fact that the rectangular module 16 is twice the length of the square module 14, it is identical in every other respect.

Accordingly, like parts on the rectangular module 16 will be identified by the same numerals as on square module 14, followed by a "prime," i.e., '.

The square module 14 comprises a square base layer 20 and a square activity layer 26.

Referring to FIG. 2*a*, the square base layer 20 may preferably be made of a plurality of sheets of suitable wood or woods which are glued to each other so that the square base layer 20 is dimensionally stable.

The square base layer 20 includes an upper surface 20*a*, a lower surface 20*b* and four sides; namely opposed sides 20*c*, 20*d*, and opposed sides 20*e*,20*f*.

Figure 4A:
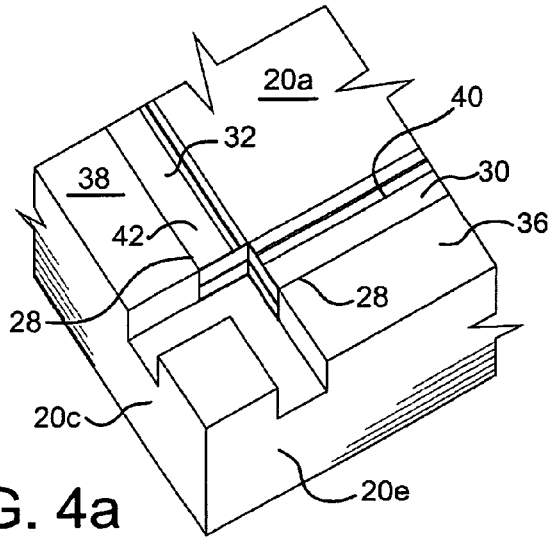
FIG. 4*a* is a detail of a part of FIG. 2*a*.

As seen in FIGS. 2*a* and 4*a* first and second upwardly facing transverse grooves 30,32 are located on upwardly facing portions 36,38 of the upper surface 20*a* near adjacent sides 20*c*,20*e*.

The upwardly facing transverse grooves 30,32 extend transversely across the upper surface 20*a* at right angles to each other.

Magnetic coupling means 28 are preferably used to releasably connect the base layer 20 to the activity layer 26 of an adjacent module 12 as will be explained.

As seen in FIGS. 2*a* and 4*a* the magnetic coupling means 28 may comprise a strip of magnetic material 40 which is disposed in upwardly facing transverse groove 30 and a strip of magnetic material 42 disposed in upwardly facing transverse groove 32.

The magnetic material 40,42 be comprised of any suitable material. However, it is preferred that both strips of magnetic material 40,42 be comprised of ceramic magnets. Means such as glue is provided for connecting the ceramic magnets to the bottom of each of the upwardly facing ceramic grooves 30,32.

Ceramic magnets 40,42 are well known. They are particularly suitable for the flooring of the invention because they are relatively inexpensive while storing stronger magnetic fields than iron.

Further, as best seen in FIG. 2*a*, if desired strips or a layer of a suitable cushioning material 46 (shown schematically) can be applied to lower surface 20*b*. The strips or layer of cushioning material 46 can be glued to the lower surface 20*b* by any well known water resistant adhesive.

The base layer 20 is preferably water resistant. As best seen in FIG. 2*b* this can be accomplished by treating the base layer in a well known manner, or by applying strips or a layer of water resistant material 48 (shown schematically) to lower surface 20*b*. The strips or layer of water resistant material 48 can be glued to the lower surface 20*b* by any well known water resistant adhesive.

Referring to FIG. 2*b*, the strips or layers of cushioning material and/or water resistant material 46 and/or 48 are not shown on lower surface 20*b* of the square base layer 20. They have been removed to simplify the drawing and to increase the understanding of the invention.

The square activity layer 26 may preferably be made of a plurality of sheets of suitable wood or woods which are glued to each other so that the activity layer 26 is dimensionally stable.

The square activity layer 26 includes an upper surface 26*a*, a lower surface 26*b* and four sides; namely opposed sides 26*c*,26*d*, and opposed sides 26*e*,26*f*.

Figure 4B:
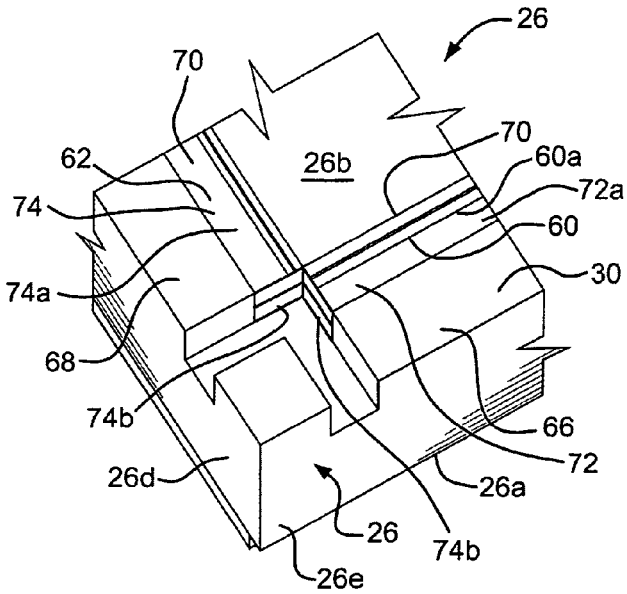
FIG. 4*b* is a detail of a part of FIG. 2*b*.

As seen in FIGS. 2*b* and 4*b* first and second downwardly facing transverse grooves 60,62 are located on downwardly facing portions 66,68 of the lower surface 26*b* near adjacent sides 26*d*,26*e*.

Figure 6A:
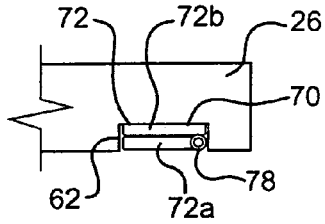
FIG. 6*a* is a detail view of the magnetic coupling means of FIG. 5 in a first position.
Figure 6B:
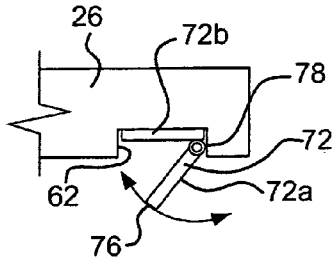
FIG. 6*b* is a detail view of the magnetic coupling means of FIG. 5 in a second position.
Figure 5:
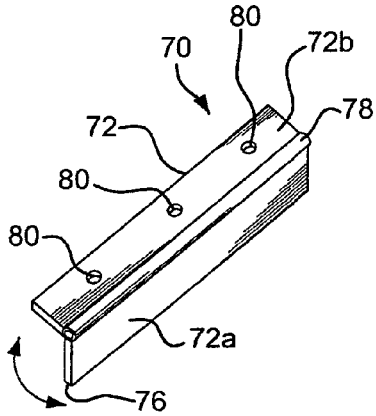
FIG. 5 is a perspective view of one of the magnetic coupling means of the invention.

As seen in FIGS. 5, 6*a* and 6*b*, second magnetic coupling means 70 cooperates with earlier mentioned magnetic coupling means 28 on the base layer 20. The second magnetic coupling means 70 comprises a first elongated member 72 which is disposed in downwardly facing transverse groove 62 and a second elongated member 74 which is disposed in downwardly facing groove 60.

As best seen in FIG. 4*b* and FIG. 5 with respect to a description of elongated member 72, the structure of elongated member 74 being identical, each elongated member 72,74 comprises an elongated strip of ferrous material 72*a*, 74*a*. Each elongated strip of ferrous material 72*a*,74*a* is connected to a second elongated element 72*b*,74*b* along their long edges by a snugly fit pivot 78.

The second elongated element 72*b*,74*b* may be connected to the downwardly facing transverse grooves 60,62 by screws (not shown) passing through suitable holes 80 or other suitable fastening means. The second elongated elements 72*b*, 74*b* and screws cooperate for connecting elongated ferrous members 73*a*,74*a* to the base and activity layers. The elongated strips of ferrous material 72*a*,74*a* can pivot about pivots 78 between a first position where they can lie against second elongated elements 72*b*,74*b* because of the snugly fit pivot 78 and a second position where they can pivot away from elements 72*a*,74*a* under the force of gravity and the attraction of the ceramic magnets 40, 42 on the base layer 20 on adjacent modules 12 when the floors 10*a*,10*b* and 10*c* are assembled as will be more completely explained.

The activity layer 26 is preferably slip resistant. This can be accomplished by treating the upper surface 26*a* of the activity layer 26 in a well known manner, or by applying a layer of slip resistant material 82 such as vinyl or the like to upper surface 26*a*. A portion of the layer of slip resistant material is shown on upper surface 26*a*.

Further, if desired for certain activities a layer of hardwood 84, a portion of which is shown on upper surface 26*a* can be attached to the upper surface 26*a*, or the entire activity layer 26 can be comprised of hardwood.

The method of assembling the floors 1*a*, 1*b* and 1*c* can best be described by referring to FIGS. 2*a*, 6*a*, 6*b*, 7 and 8.

Initially a kit comprising a plurality of modules 12 which may be square 14 and/or rectangular 16 are delivered to the site where the flooring is to be installed. The number of modules 12 in the kit is based on the area to be covered. Whether the modules are square 14 or rectangular 16 is based on the use of the floor and the needs of the customer.

Each module 12 is preferably assembled before is it delivered to the customer. Thus, the customer only has to place the modules 12 on the permanent flooring at the site.

Figure 7:
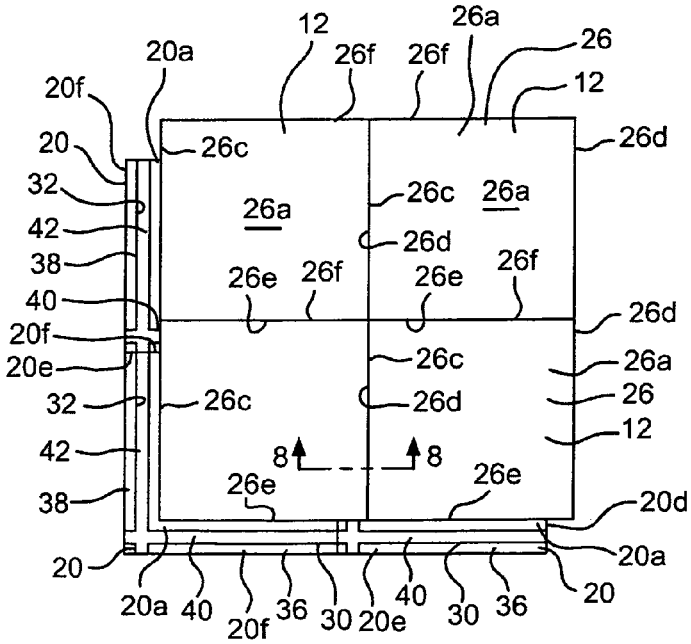
FIG. 7 is a plan view of a typical floor constructed in accordance with the showing the coupling together of adjacent modules.

As best seen in FIG. 7, the floor assembly commences by placing a the base layer 20 of a first module 12 on the permanent floor so that the upper surface 26*a* of the activity layer 26 is facing upward. As seen in FIG. 2*a* and FIG. 7, the upwardly facing portions 36 and 38 on the upper surface 20*a* of the base layer 20 are exposed and the strips of ceramic magnets 40 and 42 are visible in the upwardly facing transverse grooves 30, 32.

It can be seen that in the assembled module 12 upwardly facing portions 36,38 which are adjacent each other extend past the sides 26*c* and 26*e* of the activity layer 26.

The downwardly facing portions 66,68 of the activity layer 26 (hidden in FIG. 7) extend past the sides 20*d*,20*f* of the base layer 20 (partially hidden FIG. 7).

Figure 8:
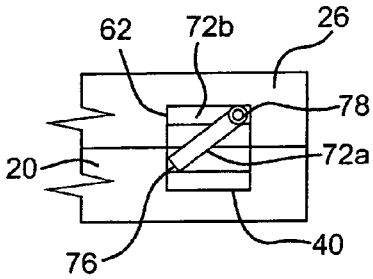
FIG. 8 is a section view taken along line 8-8 of FIG. 7.

Thus, as best seen in FIGS. 7 and 8, the elongated ferrous members 72*a*,74*a* that are in the downwardly facing grooves can overhang the upwardly facing portions 36,36 of the next adjacent module 12.

A second module 12 is placed adjacent the first module 12 with the downwardly facing portions 66,68 of the activity layer 26 (hidden in FIG. 7) that extend past the sides of the base layer 20 in touching contact with the upwardly facing portions 36,38 of the base layer 20 when the sides of the two activity layers are touching.

This will enable the ferrous member 72*a*,74*a* in the downwardly facing transverse grooves 60,62 in activity layer 26 to overlie the ceramic magnets 40,42 in the transverse grooves 30,32 in the base layer 20. As seen in FIG. 8, the magnetic attraction between the ferrous members 72*a*,74*a* and the ceramic magnets 40,42 will cause the ferrous members 72*a*, 74*a* to pivot downwardly around pivot 78 to come into contact with and engage the ceramic magnets 40,42 on the adjacent module 12 to hold the two adjacent modules 12 in close contact as seen in FIG. 7 and FIG. 8.

When a third module 12 is placed adjacent to first two modules 12, the magnetic coupling means 28 or 70 will engage the complementary magnetic coupling means 28 or 70 on the adjacent module.

Means are provided to promote and assure that the activity layers 26 on all of the modules 12 comprising the floor 10*a*, 10*b*, and 10*c* remain coplanar and do not move vertically relative to each other. Typically, this means comprises providing the sides 26*c*,26*d*,26*e*,26*f* of the activity layers with complementary tongues and grooves (not shown) in an old and well known manner.

The floor is disassembled by merely lifting and sliding the modules 12 away from each other. This can easily be accomplished since the magnetic coupling 28 and 70 are easily broken.

The modules can be stacked and stored for future use.

Thus, what has been describes is a transportable flooring system comprising modules and a method for assembling and disassembling the same without using tools.

While the invention has been described with regard to certain presently preferred embodiments, it is apparent that other forms or embodiments will be obvious skilled in the art in view of the foregoing description.

Accordingly, the scope of the invention should not be limited by the foregoing description, but rather, only by the scope of the appended claims.

The invention claimed is:

1. An activity layer for a flooring module of the type that comprises an activity layer and a base layer, said activity layer having a rectangular shape and including an upper surface and a lower surface and four sides; said sides extending between said upper and lower surfaces; said upper surface being adapted to be used for activities;

said lower surface including first and second downwardly facing grooves, said grooves extending across the lower surface of said activity layer and being closer to two adjacent ones of said sides than the opposite ones of said sides, magnetic coupling means disposed in each of said downwardly facing grooves for being connected to a complementary magnetic coupling means on an adjacent base layer, said magnetic coupling means comprises a ferrous material, each of said magnetic coupling means comprises first and second members that are connected to each other by a pivot so that said first and second members can pivot between a first position where they can lie in substantial touching relation and a second position where they are angularly disposed relative to each other, means for connecting one of said members to the bottom of said downwardly facing groove, said other member having a distal edge which is remote from said pivot, and at least said distal edge of said second member is comprised of said ferrous material so that it can pivot around said pivot to engage a complementary magnetic coupling means on an adjacent base layer.

2. In a flooring system of the type comprising a plurality of modules wherein each of said modules includes a base layer and an activity layer overlying said base layer and said base layers are connected to said activity layers in staggered relation so that a portion of each base and activity layer extends past the edges of the activity and base layers on an adjacent module, each of said activity layers including first magnetic coupling means for releasably connecting it to complimentary magnetic coupling means on said the base layer of an adjacent module, each of said base layers including second magnetic coupling means for releasably connecting it to said magnetic coupling means on said activity layer of an adjacent module and wherein said first magnetic coupling means includes a first elongated member for being connected to one of said layers, a second elongated member, a pivot, said pivot connecting said first and second elongated members so that said second elongated member can pivot movement relative to said first elongated member.

3. A flooring system of the type defined in claim 2 wherein said first elongated member is adapted to be connected to said activity layer, and said second elongated member can pivot into engagement with magnetic coupling means on said base layer.

4. A flooring system as defined in claim 3 wherein said magnetic coupling means on of one of said layers is a ceramic magnet.

5. A flooring kit for creating a sport, dance, or exercising activity floor from modules comprising a plurality of modules, each said module including a base layer for being placed on a permanent floor, said base layer including a plurality of sides, an activity layer for being placed on said base layer, said activity layer including a plurality of side edges, said base layer and said activity layer comprising said module and being in staggered relation to each other so that a portion of each of said base or activity layers extends past the sides of the other base or activity layer, each of said activity layers including first magnetic coupling means for releasably connecting it to complimentary magnetic coupling means on said base layer of another module, each of said base layers including second magnetic coupling means for releasably connecting it to said first magnetic coupling means on said activity layer of an adjacent module, one of said first or second magnetic coupling means comprises a ceramic magnet, the other of said first or second magnetic coupling means comprises an elongated ferrous member, said elongated ferrous member comprises first and second elongated elements which are connected to each other along their longest edges by a joint, said joint being operative to permit said first and second elements of said elongated ferrous member to pivot relative to each other around their longest edges, and means for connecting said elongated ferrous member to one of said base or activity layers, and means for connecting said ceramic magnet to an other of said base or activity layers.

6. An activity layer for flooring module of the type that comprises an activity layer and a base layer, said activity layer having a rectangular shape and including an upper surface and a lower surface and four sides; said sides extending between said upper and lower surfaces; said upper surface being adapted to be used for activities;

said lower surface including first and second downwardly facing grooves, said grooves extending across the lower surface of said activity layer and being closer to two adjacent ones of said sides than the opposite ones of said sides, and magnetic coupling means disposed in each of said downwardly facing grooves for being connected to a complementary magnetic coupling means on an adjacent base layer, each of said magnetic coupling means comprises first and second members that are connected to each other by a pivot so that said first and second members can pivot between a first position where they can lie in substantial touching relation and a second position where they are angularly disposed relative to each other, connection means for connecting one of said members to the bottom of said downwardly facing groove, said other member having a distal edge which is remote from said pivot, and at least said distal edge of said second member is comprised of said ferrous material so that it can pivot around said pivot to engage a complementary magnetic coupling means on an adjacent base layer.

7. In a flooring system of the type comprising a plurality of modules for being adjacent each other and wherein each of said modules includes a base layer and an activity layer overlying said base layer and said base layers are connected to said activity layers in staggered relation so that a portion of each base and activity layer extends past the sides of the activity and base layers on an adjacent module, each of said activity layers including first magnetic coupling means for releasably connecting it to complimentary magnetic coupling means on said base layer of an adjacent module, each of said base layers including second magnetic coupling means for releasably connecting it to said first magnetic coupling means on said activity layer of an adjacent module one of said first magnetic coupling means and said second magnetic coupling means includes a first elongated member for being connected to one of said layers, a second elongated member, a pivot, said pivot connecting said first and second elongated members so that said second elongated member can pivot movement relative to said first elongated member, and said second elongated member is comprised of a ferrous material so that it can engage complementary magnetic coupling means on the other one of said of said layers.

8. In a flooring system of the type comprising a plurality of modules wherein each of said modules includes a base layer and an activity layer overlying said base layer, said base layers are connected to said activity layers of adjacent modules in staggered relation so that a portion of each base and activity layer extends past the edges of the activity and base layers on an adjacent module, each of said activity layers including a first elongated magnetic member, each of said base layers including second elongated magnetic member;

said first and second elongated magnetic members being engagable with each other for releasably connecting said activity layer to a base layer of an adjacent module, and said first elongated member includes a pivot so that it can pivot into magnetic engagement with said second elongated member on said adjacent module.

9. A flooring kit for creating a sport, dance, or exercising activity floor from modules comprising a plurality of modules, each said module including a base layer for being placed on a permanent floor, said base layer including a plurality of edges, an activity layer for being placed on said base layer, said activity layer including a plurality of sides edges, means on said base layer and on said activity layer for connecting said base layer to said the activity layer of another module in staggered relation so that a portion of each layer extends past the edges of the other layer on the other, said means for connecting on each of said activity layers including first magnetic coupling means for releasably connecting it to complimentary magnetic coupling means on said the base layer of another module, said means for connecting on each of said base layers including second magnetic coupling means for releasably connecting it to said first magnetic coupling means on said activity layer of an adjacent module, said one of said first or second magnetic coupling means comprises a ceramic magnet, the other of said first or second magnetic coupling means (34) comprises an elongated ferrous member, and means for connecting said elongated ferrous member to one of said base or activity layers, and means for connecting said ceramic magnet to the other of said base or activity layers, one of said first and second magnetic coupling means comprises first and second elongated elements which are connected to each other along their longest edges by a joint, said joint being operative to permit said first and second elements to pivot relative to each other around their longest edges.

10. A flooring kit as defined in claim 9 wherein
said flooring kit comprises a plurality of modules,
said plurality of modules are for being arranged in side by side and touching relation with the portion of each activity and base layer that extends past the sides of the other layer overlying each other,
said modules being releasably connected to each other by said ceramic magnets and said ferrous members to comprise an activity floor.

11. A flooring kit as defined in claim 9 wherein
said base layers and said activity layers are the same width.

12. A flooring kit as defined in claim 11 wherein
said base layers and said activity layers are rectangular.

13. A flooring kit as defined in claim 11 wherein
said base layers and said activity layers are square.

14. A flooring kit as defined in claim 11 wherein
said some of said modules are comprised of square activity layers and square base layers,
others of said modules are comprised of rectangular activity layers and rectangular base layers, and
said modules comprising square activity layers and square base layers, and said modules comprising rectangular activity layers and rectangular base layers are of the same width.

15. A flooring kit as defined in claim 14 wherein
the length of said rectangular modules is twice the length of said square modules so that when said modules are assembled to make a floor according to the kit the seams between adjacent modules are staggered in at least one direction across the floor.

16. A flooring kit as defined in claim 9 wherein
some of said modules comprise rectangular activity layers and rectangular base layers and others of said modules comprise square activity layers and square base layers,
the length of said modules comprising rectangular activity layers and rectangular base layers is twice the length of said modules comprising square activity layers and square base layers so that when said modules are assembled to make a floor according to the kit the seams between adjacent modules are staggered in at least one direction across the floor.

17. A flooring kit as defined it claim 9
wherein said lower surface is water resistant.

18. A flooring kit as defined in claim 9
including a layer of water resistant material on said lower surface.

19. A flooring kit as defined in claim 9
including a layer of cushioning material on said lower surface.

20. A flooring kit as defined in claim 9
including a layer of vinyl on said upper surface.

21. A flooring kit as defined in claim 9 including a layer of hardwood on said upper layer.

22. An activity layer as defined in claim 9
including a layer of slip resistant material (68) on said activity layer.

23. A method for making a floor for sport, dance, or exercising activity comprising the steps of
providing a plurality of modules, each of said modules including a base layer and an activity layer, said base and activity layers of each modules overlapping each other so that a portion of each layer extends past two adjacent edges of the other layer,
moving each of said modules into contact with another module so that said portion of each activity layer and each base layer overlies said portion of said base layer and said activity layer of the adjacent module, and
magnetically coupling said adjacent modules to each other to create said floor,
the step of magnetically coupling said adjacent modules to each other includes the step of providing a first magnetically coupling means on said portions of each of said base layers, and
providing a second magnetically coupling means on said portions of each of said activity layers, and said first and second magnetically coupling means magnetically engage each other,
providing said base layers with a lower surface, and
providing a layer of water resistant material on the lower surface of said base layer.

* * * * *